US011821683B2

(12) United States Patent
Saldana

(10) Patent No.: US 11,821,683 B2
(45) Date of Patent: Nov. 21, 2023

(54) SYSTEM AND METHOD FOR CURING PLANTS IN A CONTAINER WITH A SEALED LID

(71) Applicant: Burp Lids LLC, Taylor, MI (US)

(72) Inventor: Santino Anthony Saldana, Taylor, MI (US)

(73) Assignee: Burp Lids LLC, Taylor, MI (US)

( * ) Notice: Subject to any disclaimer, the term of this patent is extended or adjusted under 35 U.S.C. 154(b) by 0 days.

(21) Appl. No.: 17/032,868

(22) Filed: Sep. 25, 2020

(65) Prior Publication Data

US 2022/0099370 A1 Mar. 31, 2022

(51) Int. Cl.

| | |
|---|---|
| ***F26B 19/00*** | (2006.01) |
| ***F26B 11/02*** | (2006.01) |
| ***A24B 15/18*** | (2006.01) |
| ***F26B 5/04*** | (2006.01) |
| ***F26B 21/08*** | (2006.01) |
| ***B65D 81/20*** | (2006.01) |
| ***F26B 21/12*** | (2006.01) |
| ***B65D 51/24*** | (2006.01) |
| ***F26B 21/00*** | (2006.01) |

(Continued)

(52) U.S. Cl.

CPC ..... *F26B 19/00* (2013.01); *A24B 15/183* (2013.01); *B65D 51/245* (2013.01); *B65D 51/30* (2013.01); *B65D 81/2038* (2013.01); *F26B 5/042* (2013.01); *F26B 11/02* (2013.01); *F26B 21/003* (2013.01); *F26B 21/08* (2013.01); *F26B 21/12* (2013.01); *A24D 1/18* (2013.01); *A24F 23/00* (2013.01); *F26B 2200/22* (2013.01)

(58) Field of Classification Search

CPC ..... F26B 19/00; F26B 5/042; F26B 11/02; F26B 21/003; F26B 21/08; F26B 21/12; F26B 2200/22; A24B 15/183; B65D 51/245; B65D 51/30; B65D 81/2038; B65D 81/20; B65D 85/52; A24D 1/18; A24F 23/00

USPC ..... 34/381, 380

See application file for complete search history.

(56) References Cited

U.S. PATENT DOCUMENTS 5,364,241 A * 11/1994 Schultz ..... F04B 33/00 53/88

6,044,756 A * 4/2000 Chang ..... B65B 31/047 220/212

(Continued)

OTHER PUBLICATIONS

Nourished Essentials, https://nourishedessentials.com/products/the-easy-fermenter (Year: 2017).*

*Primary Examiner* — John P McCormack

(74) *Attorney, Agent, or Firm* — Dickinson Wright PLLC

(57) ABSTRACT

A lid for curing organic plants. The lid is configured to be secured onto a contain with an open top, wherein the lid includes a gasket located on the bottom side of the lid, wherein the lid further includes one or more valves configured to prevent air from entering the container when the lid is secured, wherein the valve is further configured to allow air to escape the container and enter the container when actuated, wherein the lid includes a plurality of numbers associated with a calendar date and a calendar month annularly arranged on a top surface of the lid, and wherein the lid further includes a plurality of tabs, wherein the plurality of tabs are configured to move bi-directionally and include an opening configured to align and display the plurality of numbers.

20 Claims, 4 Drawing Sheets

(51) Int. Cl.

| | |
|---|---|
| ***B65D 51/30*** | (2006.01) |
| *A24D 1/18* | (2006.01) |
| *A24F 23/00* | (2006.01) |

(56) References Cited

U.S. PATENT DOCUMENTS

| | | | | |
|---|---|---|---|---|
| 6,632,283 | B1 * | 10/2003 | Singh | H01L 21/6719 118/52 |
| 7,742,360 | B1 * | 6/2010 | Price | G09F 11/23 368/10 |
| 9,750,811 | B2 * | 9/2017 | Egberg | A23L 3/3517 |
| 2004/0206682 | A1 * | 10/2004 | Hamlin | B01D 61/18 210/321.6 |
| 2017/0073126 | A1 * | 3/2017 | Comer | B65D 51/18 |
| 2018/0141738 | A1 * | 5/2018 | Armano | B65D 51/1644 |
| 2019/0322418 | A1 * | 10/2019 | Henriques | B65D 43/0218 |
| 2019/0367227 | A1 * | 12/2019 | Devine | B65D 51/1644 |
| 2022/0083946 | A1 * | 3/2022 | Cabigon | G06Q 50/02 |

* cited by examiner

SYSTEM AND METHOD FOR CURING PLANTS IN A CONTAINER WITH A SEALED LID

CROSS-REFERENCE TO RELATED APPLICATIONS

This application is claims the benefit of U.S. provisional application Ser. No. 62/906,528 filed Sep. 26, 2019, the disclosure of which is hereby incorporated in its entirety by reference herein.

TECHNICAL FIELD

The following disclosure relates to a lid and pump system that may be utilized in a container (e.g., jar), including a method for curing utilizing this system.

BACKGROUND

Some organic plants, such as cannabis plants, produce tetrahydrocannabinolic acid (THCA) and other cannabinoids through a process called biosynthesis, in which certain compounds are gradually converted into new blends. For example, THCA may become the main psychoactive compound in cannabis, THC. The process doesn't completely stop the second you cut down your plant. If you keep freshly harvested cannabis in temperatures, for example between 60 and 70° F., and humidity level between 45-55%, the conversion of non-psychoactive cannabinoids to THCA will continue and your buds will gain potency. Quick drying under warm, dry conditions halts this process much faster. Thus curing may be beneficial of your plants, such as your cannabis plants.

Furthermore, many of the aromatic compounds (terpenes) that give cannabis its unique smell and flavor are quite volatile, and can degrade and evaporate at temperatures as low as 70° F. A slow cure at low temperatures will preserve such terpenes better than a quick, hot cannabis drying process. Such conditions may also create an optimal environment for enzymes and aerobic bacteria to break down leftover minerals and the undesirable sugars produced by the decomposition of chlorophyll during the drying process. The presence of these sugars and leftover minerals may cause harsh, throat-burning sensation you get from smoking improperly cured cannabis.

SUMMARY

According to a first embodiment, a method of curing an organic plants is disclosed and includes placing the organic plant in one or more containers, securing the one or more containers with one or more lids onto the one or more containers, wherein the lids include one or more valves configured to prevent air from entering the container when the lid is secured to the container, attaching one or more pumps to the one or more valves of the lids, pumping out air from the one or more containers via the valve and pump, and releasing the valve to allow air into the one or more containers after a first time period to complete a cycle.

According to a second embodiment, a container and pump system for curing organic plants includes a container including an open top, a bottom surface, and a side wall, wherein the container is configured to store one or more organic plants. The system also contains a lid configured to be secured onto the open top, wherein the lid includes a gasket located on the bottom side of the lid, wherein the lid further includes one or more valves configured to prevent air from entering the container when the lid is secured, wherein the valve is further configured to allow air to escape the container and enter the container when actuated, wherein the lid includes a plurality of numbers associated with a calendar date and a calendar month annularly arranged on a top surface of the lid, and wherein the lid further includes a plurality of tabs, wherein the plurality of tabs are configured to move bi-directionally and include an opening configured to align and display the plurality of numbers. The system also contains a pump, wherein the pump is configured to engage with the valve and remove air from the container via the valve when the pump is activated and engage with the valve.

According to a third embodiment, a lid for curing organic plants is disclosed. The lid is configured to be secured onto a contain with an open top, wherein the lid includes a gasket located on the bottom side of the lid, wherein the lid further includes one or more valves configured to prevent air from entering the container when the lid is secured, wherein the valve is further configured to allow air to escape the container and enter the container when actuated, wherein the lid includes a plurality of numbers associated with a calendar date and a calendar month annularly arranged on a top surface of the lid, and wherein the lid further includes a plurality of tabs, wherein the plurality of tabs are configured to move bi-directionally and include an opening configured to align and display the plurality of numbers.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A proper cure may allow for the storing of the cannabis for long periods of time without worrying about mold or the loss of cannabinoid content. Well-cured flowers may be stored in an air-tight container a cool, dark place for several years (e.g., up to two years) without a significant loss of potency.

The disclosure below may describe an apparatus and method to cure cannabis. The first step may be to seal the containers and place them in a cool, dry, dark spot to finish the curing process. Within the first day, you will notice that the buds are no longer crunchy and dry on the outside, as moisture from inside the flowers rehydrates the outer portions. If this is not the case, you have over-dried your cannabis.

The cannabis or other type of organic plant may be placed in the container (e.g., jar). Unlike fermentation or pickling, the plant will typically not be submerged in a liquid. During the first week, open the containers several times per day and let the flowers "breathe" for a few minutes. This allows moisture to escape and replenishes the oxygen inside the container. If you notice the odor of ammonia when opening a container, it means the buds are not dry enough to be cured and anaerobic bacteria are consuming them, which will lead to moldy, rotten cannabis. After the first week, you will only need to open the containers once every few days or so.

After 2 to 3 weeks in containers, the plant and cannabis may be cured enough to provide a quality experience, but 4 to 8 weeks of cure time will improve it even more. Some strains benefit from 6 months or more of curing.

The curing process is possibly the most overlooked aspect of cannabis production, one that was all but ignored when the black market was an only option. Due to competition in the medical and recreational cannabis markets, more producers are paying attention to this process that turns a decent product into a truly excellent one, and now you can do the same with your homegrown flowers.

Figure 1:
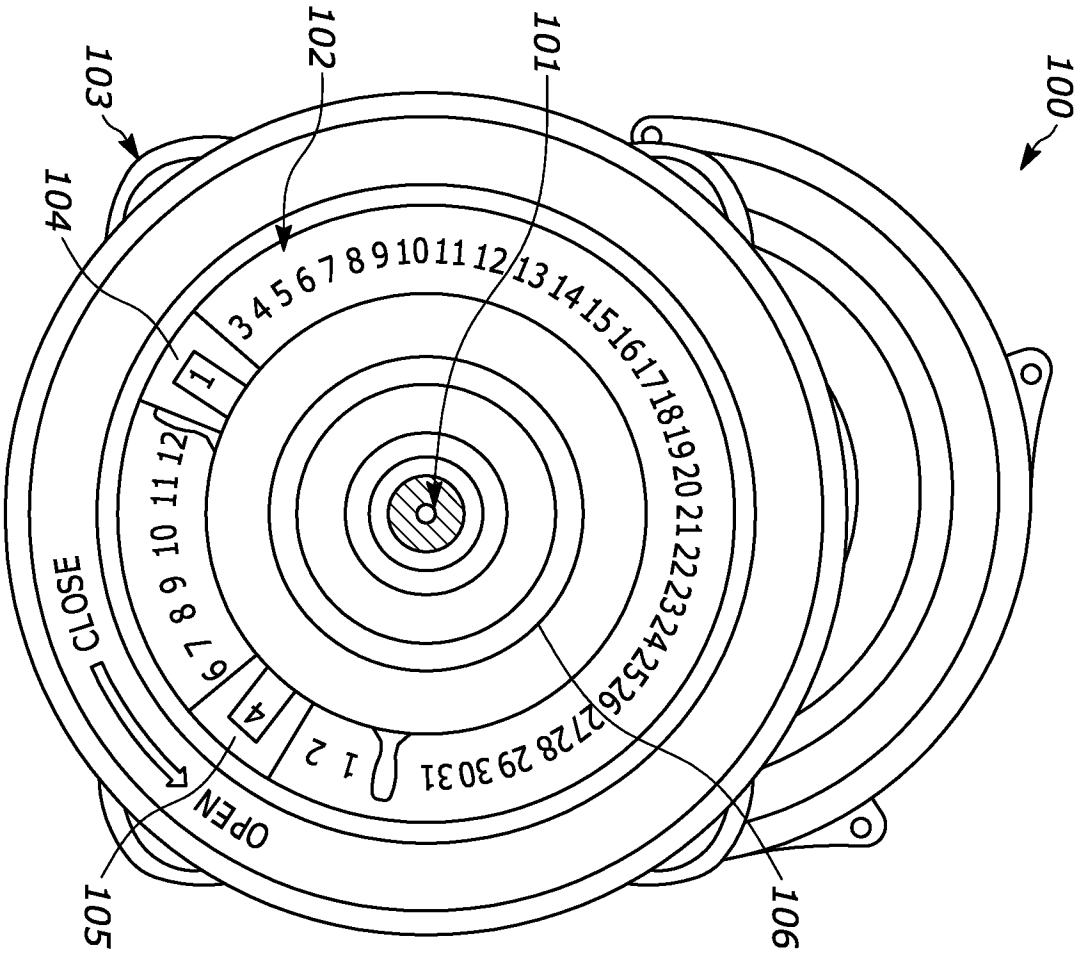
FIG. 1 discloses a top perspective view of a lid.

FIG. 1 discloses a top perspective view of a lid. The lid 100 may be utilized to secure on top of a container, such as a jar or other container, to prevent bacteria, liquid, and other harmful particles entering the jar. The lid 100 may include a valve 101. The valve 101 may be utilized to prevent air from entering the lid. However, the valve 101 may allow air from the atmosphere surrounding the container to enter when actuated. The valve 101 may also allow air to escape from the jar when actuated. As described in more detail below, the valve may interact with a pump to create a vacuum or vacuum-like setting in the container when the pump engages with the valve to extract out air. The valve 101 may be a rubber-like material and may be a same or different material than the rest of the lid. The valve 101 may be softer to allow flexibility to create an air-tight connection with the pump. The valve 101 may further be configured to actuate in response to activation of a release tab. The lid 100 may also include projections 103 that are utilized to help with gripping to create a seal with a container or to open the lid from the container once secured. The projections 103 may include any number of projections around the lid, such as one projection, two projections, three projections, four projections, etc. A bottom surface of the container includes one or more light emitting diodes configured to emit light in response to activation of a switch.

An embodiment of the lid 100 may include an annular calendar that includes options to monitor both the month and date. A day tab 104 may be utilized to circle the lid in order to identify the numerical date that a curing process has begun, or any other type of process. A month tab 105 may be utilized to identify the month that a process has ton. Each lid may include such tabs 104, 105 to help monitor processes and avoid utilizing extra equipment (e.g., pens, notepads, etc.) for storage and curing of the organic plants.

Figure 2:
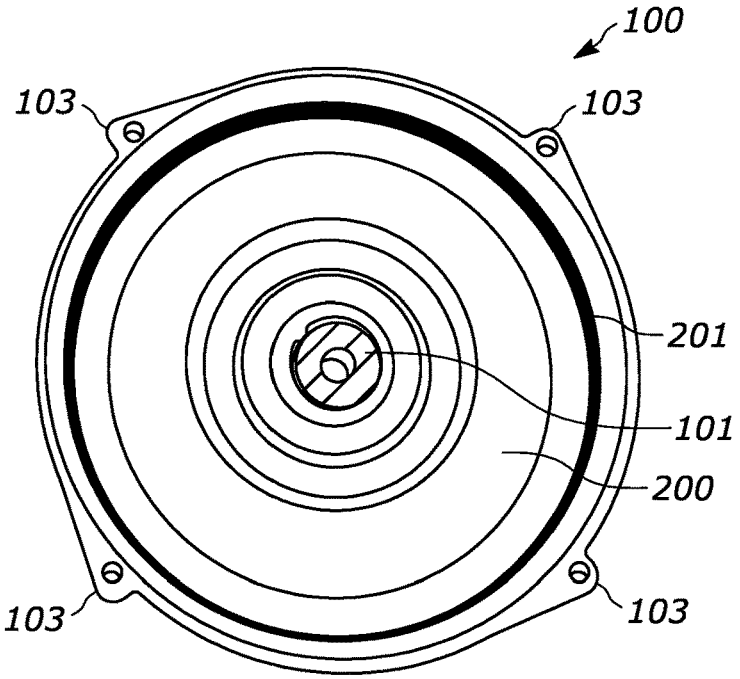
FIG. 2 discloses a bottom perspective view of a lid.

FIG. 2 discloses a bottom perspective view of a lid 100. The bottom side 200 of the lid may include a gasket 201 to help ensure that a seal is secured to the lid and does not allow air to enter into the lid. The gasket 201 may be utilized to create a seal around a lip, channel, or projection around an opening of the mouth of the container. The bottom side of the valve 101 may shown and seen from the bottom perspective of the lid 100.

In one embodiment, the lid 100 may include a filter in the valve 101. The filter may be a carbon filter or any other type of filter that may be utilized to trap any harmful particles from entering the container when being "burped." For example, the carbon filter may be utilized to remove gases but filter volatile organic compounds released in the air. The filter may trap harmful bacteria or mold particles that are in the air (e.g., inside the container or outside the container) that may effect potency, taste, and smell of the plants being cured.

In another embodiment, the lid 100 may include a container section to store humidity packs or other humidity-regulating packager located on the bottom side of the lid. The packages may be stored in the lid in a container section. The container section may have perforations or holes to allow moisture from the humidity-regulating packages extract into the air. In yet another embodiment, humidity packs may be stored on the lid via a food-grade adhesive, such as Permabond or other epoxy based adhesives. The humidity packs may be annular and shape and rest around an annular ring of the bottom surface of the lid. Such an annular humidity pack may be utilized to maintain humidity in the container, mitigate any toxins coming in from the glue or the pack, and provide maximum storage space for the plants being cured in the container. In still yet another embodiment, the lid 100 may include an annular humidity pack including a first surface including an adhesive, and a second surface including a carbon filter, wherein the first surface is configured to stick to a bottom surface of the lid via the adhesive.

The lid 100 may also be equipped with a hygrometer that may be utilized to measure the humidity. The hygrometer may include a sensor and measurement device within the container to measure the moisture. However, a display outside of the lid can be visible to show the humidity to a user when the lid is secured. The display may be digital or analog.

Figure 3:
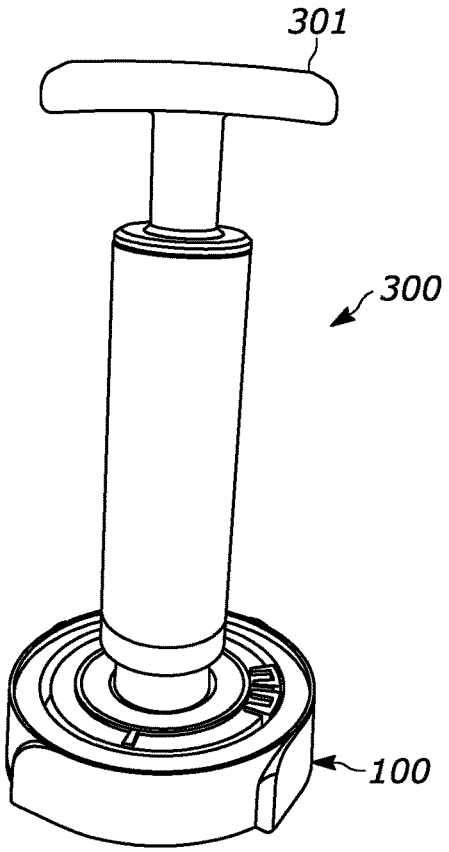
FIG. 3 discloses a perspective view of a pump and lid engaged.

FIG. 3 discloses a perspective view of a pump 300 and lid 100 engaged. A bottom portion 303 of the pump may engage with the valve portion 101 of the lid 100 to ensure that an air-tight connection is created. When such a connection is created, the system may operate to create a vacuum in a container that the lid is secured onto.

Figure 4A:
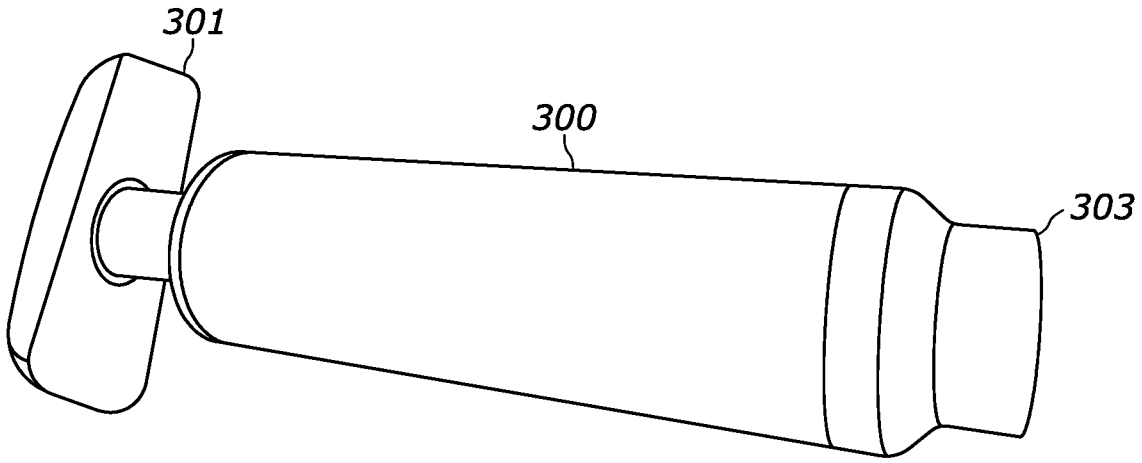
FIG. 4A discloses a perspective view of the pump.

FIG. 4A discloses a perspective view of the pump 300. The pump 300 may include a handle 301 that allows a user to grip the pump. The handle 301 may be actuated up and down. As the handle is actuated to cause the pump to move up, air may be removed and sucked through an orifice 305 at the bottom portion 303 of the pump 300. Thus, when the pump 300 engages with the valve 101 of the lid, the air from the lid may be extracted out of the container to help the curing process.

Figure 4B:
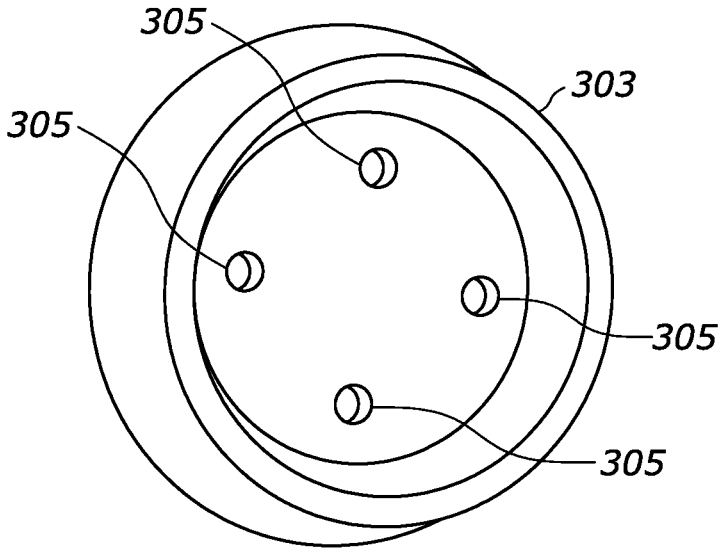
FIG. 4B discloses a bottom view of the pump.

FIG. 4B discloses a bottom view of the pump. The pump may include several holes 405 that allow the air to be extracted when the pump is engaged. The bottom portion of the pump may engage with the lid to create an airtight connection so that when the pump is engaged, the valve removes air via the pump, without allowing fresh air to enter into the container. The holes or orifices at the bottom of the pump may engage with the valve to extract the air out of the container. For example, the four holes pictured in the embodiment of the figure may engage with the airlock valve. It may provide a suction and lifts the valve so that the stale air can be pulled out. Because the pump creates an air-tight connection with the valve, air from the atmosphere is not extracted out, and instead, air from the container is pulled out. Thus in the curing process, stale air may be removed from the container.

The valve stem located on the lid may be spring-biased to the normally closed position. This ensures that upon release of the actuator by the user, the valve stem and an associated valve seat will return to a closed position, thereby maintaining the system vacuum in the container. Other valves may also be used without departing from the scope of the present invention.

Figure 5:
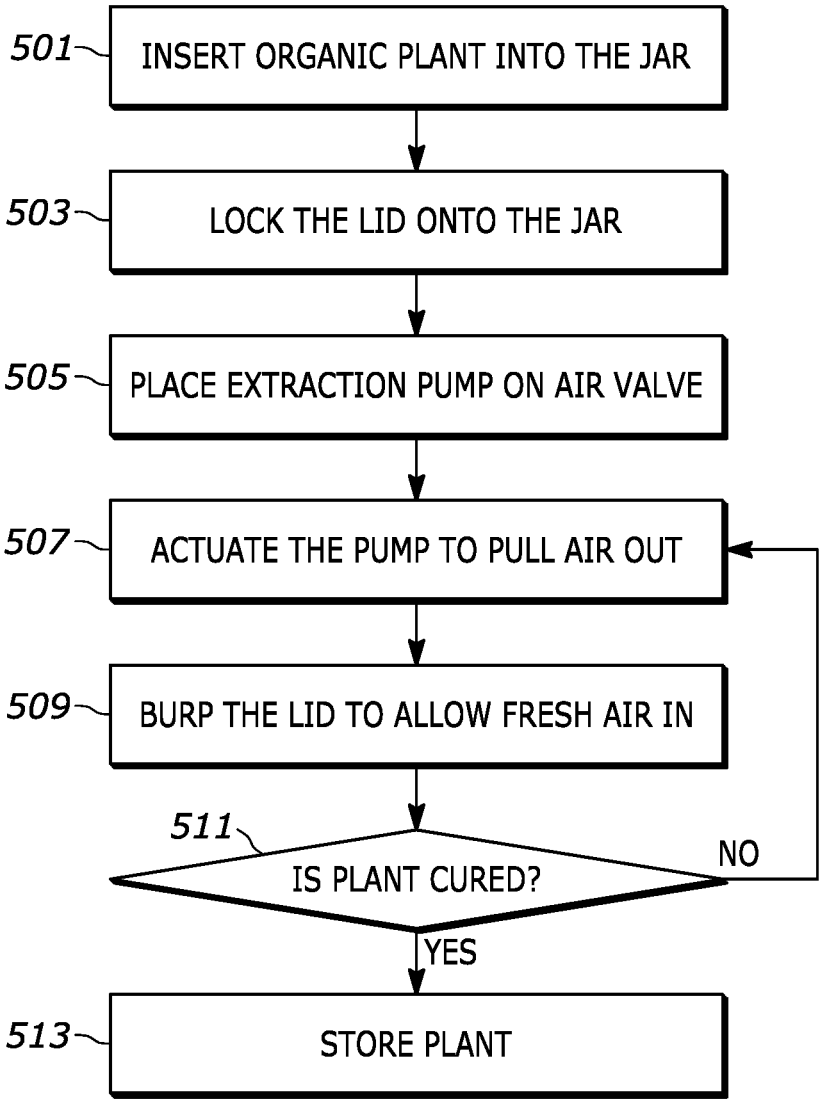
FIG. 5 disclose a flow chart illustrating a curing method utilizing the pump and lid system.

FIG. 5 disclose a flow chart illustrating a curing method utilizing the pump and lid system. At step 501, a person may place organic plants into the container. The plants may be placed in a relatively liquid-free container. Thus, any excess liquid may be removed to ensure that the condensation does not cause issues in the curing process. However, humidity packs may be added to ensure that the air is not too dry. Thus, while liquid may be problematic, a humidity range between 60-65% may be ideal during the curing process for an organic plant (e.g., cannabis), but humidity between 55-85% may be utilized.

At step 503, the next step may be lock the lid onto the container with the organic plant in the container. The container may have an opening that needs to be covered to ensure no bacteria enters into the container and effects the curing process of the organic plant. The lid described in the embodiments above may thus be utilized on the container. In one example, the lid may fit onto a standard Mason jar mouth. After a few turns, the lid may be secured onto the container.

At step 505, the user may place the extraction pump on the air valve of the lid. The bottom of the pump may have to engage with the top of the air valve. Once engaged, the pump and valve work in unison to allow air to be pulled out of the container. The pump creates an air tight seal with the valve and allows the air to be pulled out without any air being entered into the container because of the valve.

At step 507, the system may actuate the pump to pull air out of the container. The pump may extract stale air with the pump. The air in the container may be stale after being stored with the organic plant for so many hours.

At step 509, it may be beneficial to burp the lid to allow fresh air in. The container may be burped by activating the valve located on the lid. Thus, when the valve is located, the valve then burp the valve to pull fresh air into the container. By burping the lid to allow fresh air in, the container system may allow for fresh air to be brought into the container without taking time removing lids and placing the lids back on. Furthermore, the date tracker can be adjusted to identify when the last "burp" took place without removing the lid.

At decision 511, the person may monitor if the plant is fully cured. The plant may be cured based upon the dates that are aligned on the top of the lid of lid utilizing the date trackers. Different strands and plants may have different curing tendencies.

At step 513, the plant may be taken out of the container and stored. In another embodiment, the container itself may be utilized as the storage for the lid. If the container and lid is utilized for storage, curing may occur, but may happen at a lesser frequency then when initially curing. The cured plant may also be stored in vacuum sealed containers.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of curing an organic volatile plant, comprising:

placing the organic volatile plant in a Mason jar without a liquid;

securing the Mason jar with one or more lids onto the one or more containers, wherein the one or more lids include one or more valves configured to prevent air from entering the Mason jar when the lid is secured to the Mason jar upon turning the lid onto the Mason jar via a plurality of projections extending from an outer perimeter of the lid, wherein the projections are configured to facilitate a grip upon turning the lid;

setting a first time period for curing the organic plant using a date tracker including a plurality of numbers associated with a calendar date and a calendar month annularly arranged on a top surface of the one or more lid;

attaching one or more hand pumps to the one or more valves of the lids, wherein the pumps are in direct connection with the valves of the lids when the pumps are attached to the valves;

pumping out air from the Mason jar via the valve and hand pump;

releasing the valve to allow air into the Mason jar after a first time period to complete a cycle; and removing the organic volatile plant after at least two weeks in the Mason jar.

2. The method of claim 1, wherein the method further includes adding a humidity package to the Mason jar, wherein the humidity package is configured to regulate humidity.

3. The method of claim 1, wherein the method further includes, in response to releasing the valve to allow air into the Mason jar, pumping out air from the Mason jar via the valve and pump after a second time period.

4. The method of claim 1, wherein the method further includes removing the lid from the Mason jar after a first threshold of cycles.

5. The system of claim 1, wherein the first time period is one day.

6. The method of claim 1, wherein the cycle is repeated.

7. A container and pump system for curing volatile organic plants, comprising:

a Mason jar including an open top, a bottom surface, and a side wall, wherein the Mason jar is an industry standard container and configured to store one or more organic plants; and a lid configured to be secured onto the open top, wherein the lid includes a gasket located on the bottom side of the lid, wherein the lid is configured to engage with the Mason jar, wherein the lid further includes one or more valves configured to prevent air from entering the Mason jar when the lid is secured, wherein the valve is further configured to allow air to escape the Mason jar and enter the Mason jar when actuated, wherein the valve extends upwardly from a top side of the lid, wherein the lid includes a plurality of numbers associated with a calendar date and a calendar month annularly arranged on a top surface of the lid, and wherein the lid further includes a plurality of tabs, wherein the plurality of tabs are configured to move bi-directionally and include an opening configured to align and display the plurality of numbers, wherein the lid includes at least two projections protruding out of a side of the lid configured to facilitate with gripping the lid; and a detachable pump, wherein the pump is a hand pump configured to engage with the valve and remove air from the Mason jar via the valve when the pump is activated and engaged with the valve, and wherein the pump is in direct connection with the valve of the lid when the pump engages with the valve.

8. The container and pump system of claim 7, wherein the valve includes a filter configured to trap bacteria entering or exiting the valve.

9. The container and pump system of claim 7, wherein the lid includes a bottom side, wherein the bottom side includes a humidity pack configured to regulate a humidity of the Mason jar.

10. The container and pump system of claim 7, wherein the lid includes a bottom side, wherein the bottom side includes a first housing that includes one or more perforations.

11. The container and pump system of claim 7, wherein the bottom surface includes one or more light emitting diodes configured to emit light in response to activation of a switch.

12. The container and pump system of claim 7, wherein the valve is further configured to actuate in response to activation of a release tab.

13. The container of claim 7, wherein the lid includes an annular humidity pack including a first surface including an adhesive, and a second surface including a carbon filter, wherein the first surface is configured to stick to a bottom surface of the lid via the adhesive.

14. A lid for curing organic plants, comprising:

a lid configured to be secured onto a glass jar with an open top, wherein the lid is configured to be secured onto the glass jar in response to turning projections protruding from the lid, wherein the lid includes a gasket located on the bottom side of the lid, wherein the lid further includes one or more valves configured to prevent air from entering the glass jar when the lid is secured, wherein the valve is further configured to allow air to escape the glass jar and enter the glass jar when actuated, wherein the valve extends upwardly from a top side of the lid, wherein the lid includes a plurality of numbers associated with a calendar date and a calendar month annularly arranged on a top surface of the lid, and wherein the lid further includes a plurality of tabs, wherein the plurality of tabs are configured to move bi-directionally and include an opening configured to align and display the plurality of numbers, wherein the lid includes at least two projections protruding out of a side of the lid configured to facilitate with gripping the lid.

15. The lid of claim 14, wherein the system includes a pump, wherein the pump is configured to engage with the valve and remove air from the glass jar via the valve when the pump is activated and engaged with the valve, and wherein the pump is in direct connection with the valve of the lid when the pump engages with the valve.

16. The lid of claim 14, wherein the lid is an annular lid that includes at least four projections protruding out of a side of the lid.

17. The lid of claim 14, wherein the lid includes a bottom side, wherein the bottom side includes a first housing that includes one or more perforations.

18. The lid of claim 14, wherein the bottom surface includes one or more light emitting diodes configured to emit light in response to activation of a switch.

19. The lid of claim 14, wherein the at least two projections are equally spaced apart.

20. The method of claim 19, wherein the method includes adjusting the date tracker upon completing the cycle.

* * * * *